US010129668B2

(12) United States Patent
Anderson

(10) Patent No.: US 10,129,668 B2
(45) Date of Patent: Nov. 13, 2018

(54) EARMOLD FOR ACTIVE OCCLUSION CANCELLATION

(71) Applicant: GN Hearing A/S, Ballerup (DK)

(72) Inventor: James Robert Anderson, Chicago, IL (US)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 14/145,348

(22) Filed: Dec. 31, 2013

(65) Prior Publication Data

US 2015/0189454 A1 Jul. 2, 2015

(51) Int. Cl.
*H04R 25/00* (2006.01)

(52) U.S. Cl.
CPC ..... *H04R 25/652* (2013.01); *H04R 25/65* (2013.01); *H04R 25/608* (2013.01); *H04R 2460/05* (2013.01)

(58) Field of Classification Search
CPC .... H04R 1/1016; H04R 25/652; H04R 25/65; H04R 25/608; H04R 2460/05; H04W 4/02; H04W 4/16; B60Q 1/52; B60R 21/01; B60R 2021/01061; G01S 19/17; G08G 1/205; H04M 19/04
USPC ..... 381/328
See application file for complete search history.

(56) References Cited

U.S. PATENT DOCUMENTS 5,909,498 A * 6/1999 Smith ..... H04R 1/1016 381/375
2002/0164041 A1* 11/2002 Zurek ..... 381/313
2007/0003085 A1* 1/2007 Meier ..... H04R 25/652 381/328
2008/0063228 A1 3/2008 Mejia et al.
2008/0075310 A1 3/2008 Arndt et al.
2008/0123866 A1 5/2008 Rule et al.
2008/0144868 A1 6/2008 Stirnemann et al.
2009/0080670 A1 3/2009 Solbeck et al.
2009/0238387 A1 9/2009 Arndt et al.
(Continued)

FOREIGN PATENT DOCUMENTS

GB 2498260 A 7/2013
JP H05-199590 8/1993
(Continued)

OTHER PUBLICATIONS

Extended European Search Report dated May 13, 2015, for corresponding European Patent Application No. 14198558.0, 10 pages.
Jim Curran, "A Forgotten Technique for Resolving the Occlusion Effect", Reprinted from Innovations: vol. 2, Issue 2, 2012 Starkey Audiology Series, Jan. 1, 2012, 7 pages.
First Technical Examination dated Jul. 9, 2015, for corresponding Danish Patent Application No. PA 2014 70796, 6 pages.
(Continued)

*Primary Examiner* — Sean H Nguyen
(74) *Attorney, Agent, or Firm* — Vista IP Law Group, LLP

(57) ABSTRACT

An earmold for an ear canal of a user, the earmold having an earmold shell and extending along an axis, the earmold shell having a tip end, the tip end facing a tympanic membrane of the user when worn by the user, the earmold includes: a first microphone connected to a first microphone opening for receiving sound in the ear canal, wherein the first microphone opening is arranged in a first position at a first distance from the tip end of the earmold shell; and a receiver opening for providing sound in the ear canal, wherein the receiver opening is arranged in a second position at a second distance from the tip end of the earmold shell; wherein the first position is different from the second position.

25 Claims, 6 Drawing Sheets

(56) References Cited

U.S. PATENT DOCUMENTS

| | | | | |
|---|---|---|---|---|
| 2012/0008808 | A1* | 1/2012 | Saltykov | 381/317 |
| 2013/0051592 | A1* | 2/2013 | Campbell | H04R 25/656 381/328 |
| 2013/0243209 | A1 | 9/2013 | Zurbruegg et al. | |

FOREIGN PATENT DOCUMENTS

| | | | |
|---|---|---|---|
| JP | 3111043 | U | 7/2005 |
| JP | 2007-235364 | A | 9/2007 |
| JP | 2008-199192 | A | 8/2008 |
| JP | 2009-284097 | A | 12/2009 |
| JP | 2011-166815 | A | 8/2011 |
| WO | WO 2006/037156 | A1 | 4/2006 |
| WO | WO 2012/085514 | A2 | 6/2012 |
| WO | WO 2012/085514 | A3 | 6/2012 |

OTHER PUBLICATIONS

Notification of Reason for Rejection dated Jan. 24, 2017 for corresponding Japanese Patent Application No. 2014-261181, 7 pages.

Notification of Second Notice of Reason for Rejection dated Aug. 8, 2017 for corresponding Japanese Patent Application No. 2014-261181, 4 pages.

JP 2011-166815A; Electroacoustic transducer—Japanese application published Aug. 25, 2011, Toshiba Corp.—English translation.

First Office Action dated Feb. 14, 2018, for corresponding Chinese Patent Application No. 201410855348.9.

English translation of First Office Action dated Feb. 14, 2018, for corresponding Chinese Patent Application No. 201410855348.9.

* cited by examiner

EARMOLD FOR ACTIVE OCCLUSION CANCELLATION

FIELD

The present disclosure relates to an earmold and in particular to earmold, device and methods for active occlusion cancellation in a hearing device, such as a headset or a hearing aid.

BACKGROUND

Occlusion has for long been recognized as a problem for some hearing aid users, and continuous efforts have been made to reduce the occlusion effect.

Known solutions to reduce the occlusion effect provide a vent in the earpiece or earmold in order to allow pressure equalization between the ear canal and the surroundings.

Further, active occlusion cancellation (AOC) systems have been developed, the AOC systems having a canal microphone in the ear canal and being arranged along with the receiver at the tip of the earmold.

SUMMARY

Despite the known solutions there is still a need for improved occlusion cancellation, in particular in a hearing device.

Accordingly, an earmold for an ear canal of a user is provided, the earmold having an earmold shell and extending along an axis, the earmold shell having a tip end, the tip end facing a tympanic membrane of the user when worn by the user, the earmold comprising a first microphone connected to a first microphone opening for receiving sound in the ear canal, wherein the first microphone opening is arranged in a first position at a first distance from the tip end; and a receiver opening for producing sound in the ear canal, wherein the receiver opening is arranged in a second position at a second distance from the tip end. The first position may be different from the second position.

Also disclosed is a hearing device comprising an earmold as disclosed herein, the hearing device or the earmold comprising a processing unit connected to the receiver and the first microphone, wherein the processing unit comprises an occlusion cancelling unit configured to modify an output signal to the receiver based on an input signal from the first microphone.

It is an important advantage that near field effects of the receiver and/or the vent are substantially reduced, thus providing improved occlusion cancellation.

Further, it is an advantage that a more controlled closed loop transfer function for active occlusion cancellation is provided, which in turn facilitates improved occlusion cancellation.

Advantageously, the earmold enables a more accurate measurement/determination of in-situ canal sound pressure for higher frequencies.

An earmold for an ear canal of a user, the earmold having an earmold shell and extending along an axis, the earmold shell having a tip end, the tip end facing a tympanic membrane of the user when worn by the user, the earmold includes: a first microphone connected to a first microphone opening for receiving sound in the ear canal, wherein the first microphone opening is arranged in a first position at a first distance from the tip end of the earmold shell; and a receiver opening for providing sound in the ear canal, wherein the receiver opening is arranged in a second position at a second distance from the tip end of the earmold shell; wherein the first position is different from the second position.

Optionally, the first microphone opening and the receiver opening are offset from each other in a direction that is perpendicular to the axis.

Optionally, the first distance is smaller than the second distance.

Optionally, a distance between the first position and the second position is at least 1 mm.

Optionally, a distance between the first position and the second position is anywhere from 1.5 mm to 5 mm.

Optionally, the earmold further includes a vent channel with a vent opening for venting the ear canal, wherein the vent opening is arranged in a third position at a third distance from the tip end along the axis, and wherein the first position is different from the third position.

Optionally, a distance between the first position and the third position is at least 1 mm.

Optionally, a distance between the first position and the third position is anywhere from 1.5 mm to 5 mm.

Optionally, the second position is different from the third position.

Optionally, the first distance is less than 1 mm.

Optionally, the first microphone opening and/or the receiver opening are arranged in the earmold shell.

Optionally, the earmold further includes a microphone tube extending from the earmold shell, wherein the first microphone opening is at a distal end of the microphone tube.

Optionally, the earmold further includes a receiver tube extending from the earmold shell, wherein the receiver opening is at a distal end of the receiver tube.

Optionally, the earmold further includes a receiver connected to the receiver opening.

A hearing device includes the earmold, the hearing device comprising a processing unit connected to a receiver and a microphone, wherein the processing unit comprises an occlusion cancelling unit configured to provide an output signal to the receiver based on an input signal from the microphone.

Other and further aspects and features will be evident from reading the following detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
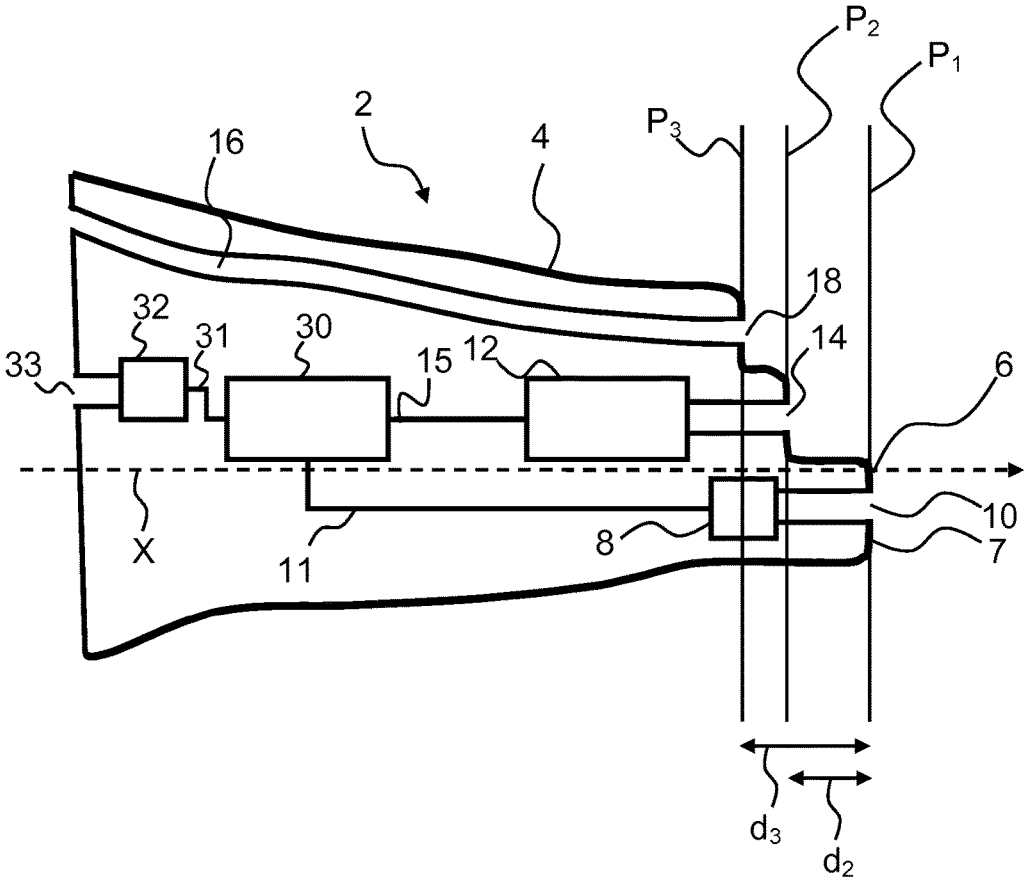
FIG. 1 schematically illustrates an exemplary earmold.

Various embodiments are described hereinafter with reference to the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The earmold has an earmold shell. The earmold shell has an outer surface. The outer surface may be configured to fit into the ear canal of a user of the earmold.

The earmold extends along an axis. The axis may be parallel to the longitudinal direction of the earmold. The axis may be substantially parallel with the ear canal i.e. within 2-5 degrees.

The earmold has a tip end (distal end) with a tip surface facing a tympanic membrane of the user when worn by the user. The axis may perpendicular to or substantially perpendicular to the tip surface. The tip surface may be plane or rounded. Further, the earmold has a proximal end. The earmold may have a proximal surface facing away from the tympanic membrane when worn by the user.

The earmold comprises a first microphone, also denoted canal microphone, connected to a first microphone opening for receiving sound in the ear canal. The first microphone acting as an ear canal microphone may be connected to the first microphone opening via a microphone duct formed by a microphone tube and/or a microphone channel in the earmold shell. The first microphone opening may be perpendicular to the axis or angled e.g. with an angle in the range from 70 degrees to 110 degrees, thus pointing into the ear canal of a user.

The first microphone opening is arranged in a first position at a first distance from the tip end (measured along the axis). The first distance may be in the range from 0 to 8 mm. The first microphone opening may be arranged near or at the tip end. For example, the first distance may be less than 2 mm. The first microphone opening may be arranged between the tip end and the proximal end of the earmold. The first microphone opening may be arranged between the tip end and the tympanic membrane. The first microphone opening may have a diameter of at least 0.5 mm.

The earmold comprises a receiver opening. The earmold may comprise a receiver connected to the receiver opening for producing sound in the ear canal. The receiver may be connected to the receiver opening via a receiver duct formed by a receiver tube and/or a receiver channel in the earmold shell. The receiver opening may be perpendicular to the axis or angled e.g. with an angle in the range from 70 degrees to 110 degrees, thus pointing into the ear canal of a user.

The receiver opening is arranged in a second position at a second distance from the tip end (measured along the axis). The second distance may be in the range from 0 to 8 mm. The first microphone opening and the receiver opening may be separated in a transverse plane perpendicular to the axis such that the first microphone opening and the receiver opening do not coincide. The receiver opening may have a diameter of at least 0.5 mm.

The first microphone opening and the receiver opening may be separated when projected onto a transverse plane perpendicular to the axis.

The first distance may be the same as or different from the second distance. The distance between the first position and the second position may be at least 1 mm. The distance (measured along the axis) between the first position (first microphone opening) and the second position (receiver opening) may be in the range from 1.5 mm to 5 mm.

The first distance may be smaller than the second distance.

The first microphone opening and the receiver opening may have a transverse distance (first transverse distance) of at least 1 mm, such as in the range from 2 to 5 mm. The transverse distance between two openings is the distance between respective centers of the two openings projected onto a plane perpendicular to the axis.

The earmold may comprise a vent channel with a vent opening for venting the ear canal, wherein the vent opening is arranged in a third position at a third distance from the tip end (measured along the axis). The first microphone opening and the vent opening may be separated in a transverse plane perpendicular to the axis such that the first microphone opening and the vent opening do not coincide. The vent opening may have a diameter of at least 0.5 mm.

The first distance may be the same as or different from the third distance. The distance between the first position and the third position may be at least 1 mm. The distance between the first position and the third position may be in the range from 1.5 mm to 5 mm.

The second distance may be different from the third distance. The second position may be the same as or different from the third position. The distance between the second position and the third position may be at least 1 mm. The distance between the second position and the third position may be in the range from 1.5 mm to 5 mm.

The distance between the second position and the third position may less than 1 mm.

The first microphone opening and the vent opening may be separated when projected onto a transverse plane perpendicular to the axis. The first microphone opening and the vent opening may have a transverse distance (second transverse distance) of at least 1 mm, such as in the range from 2 to 5 mm. The receiver opening and the vent opening may have a transverse distance (third transverse distance) of at least 1 mm, such as in the range from 2 to 5 mm.

The first microphone opening and/or the receiver opening may be arranged in the earmold shell.

The first microphone opening, the receiver opening and the vent opening may be arranged along a straight line perpendicular to the axis. The first microphone opening, the receiver opening and the vent opening may be arranged in a triangle when seen from the tip end, e.g. a triangle where all angles are less than 100 degrees, such as less than 80 degrees.

The earmold may comprise a microphone tube extending from the earmold shell with the first microphone opening formed at a distal end of the microphone tube. Hereby, the first microphone opening may be positioned close to the tympanic membrane, which may be desirable to obtain accurate determination of sound pressure variations.

The earmold may comprise a receiver tube extending from the earmold shell with the receiver opening formed at a distal end of the receiver tube. Hereby, the receiver opening may be positioned close to the tympanic membrane, which may be desirable to obtain improved audio transfer from the receiver to the tympanic membrane.

The earmold may comprise a vent tube extending from the earmold shell with the vent opening formed at a distal end of the vent tube.

The earmold or a hearing device comprising the earmold may comprise a processing unit connected to the receiver and the first microphone, wherein the processing unit comprises an occlusion cancelling unit configured to modify an output signal to the receiver based on the signal to the first microphone.

The earmold may comprise a second microphone for receiving sound from the surroundings. The second microphone or an associated second microphone opening may be positioned in a proximal surface of the earmold and/or in proximity to the proximal end. One or more second microphones may be arranged in a hearing aid housing or part external to the earmold.

The processing unit may be connected to one or more second microphones for receiving sound from the surroundings, wherein the processing unit comprises an occlusion cancelling unit configured to modify an output signal to the receiver based on an input signal from the first and second microphones.

The hearing device may be an in-the-ear (ITE) hearing device, in-the-canal (ITC) hearing device, completely-in-canal (CIC) hearing device, or invisible-in-the-canal (IIC) hearing device.

The hearing device may be a receiver-in-the-ear (RITE) hearing device, or a receiver-in-canal (RIC) hearing device. The hearing device may be a behind-the-ear (BTE) hearing device, e.g. where the receiver is arranged in a housing configured to be positioned behind the ear of a user.

The hearing device may be a hearing aid, i.e. with a processing unit configured to compensate for hearing loss of a user.

FIG. 1 schematically illustrates an exemplary earmold for an ear canal of a user. The earmold 2 has an earmold shell 4 and extends along an axis X. The earmold 2 has a tip end 6 with a tip surface 7 facing a tympanic membrane (not shown) of the user when worn by the user. The axis X is perpendicular to the tip surface 7. The earmold 2 comprises a first microphone (canal microphone) 8 connected to a first microphone opening 10 for receiving sound in the ear canal. The first microphone opening 10 is arranged in a first position at a first distance $d_1$ from the tip end 6 along the axis X. In FIG. 1, the first microphone opening is arranged in the tip surface, i.e. the first distance $d_1=0$. The first microphone 8 is connected to the processing unit 30 via first conductor 11 for feeding an input signal from the first microphone 8 to the processing unit 30. Further, the earmold 2 comprises a receiver 12 connected to a receiver opening 14 for producing sound in the ear canal, wherein the receiver opening 14 is arranged in a second position at a second distance $d_2$ from the tip end 6 along the axis X. The second distance $d_2=2$ mm, thus the first distance $d_1$ is different from the second distance $d_2$. Displacement of the first microphone opening and the receiver opening along the axis X reduces near field effects of the receiver, especially at high frequencies, leading to improved and more precise in-situ canal pressure measurements performed by canal microphone 8. The receiver 12 is connected to the processing unit 30 via second conductor 15 for receiving output signal from the processing unit 30. The first microphone opening 10 is arranged in a microphone plane $P_1$ perpendicular to the axis X. The receiver opening 14 is arranged in a receiver plane $P_2$ perpendicular to the axis X.

The earmold 2 comprises a vent channel 16 with a vent opening 18 for venting the ear canal. The vent opening 18 is arranged in a third position at a third distance $d_3$ ($d_3=3$ mm) from the tip 6 end along the axis X. The vent opening 18 is arranged in a vent plane $P_3$ perpendicular to the axis X.

In one or more exemplary earmolds, microphone plane $P_1$, receiver plane $P_2$, and vent plane $P_3$ may be non-perpendicular to the axis X. Microphone plane $P_1$ and receiver plane $P_2$ may be non-parallel. Microphone plane $P_1$ and vent plane $P_3$ may be non-parallel. Receiver plane $P_2$, and vent plane $P_3$ may be non-parallel.

Figure 3:
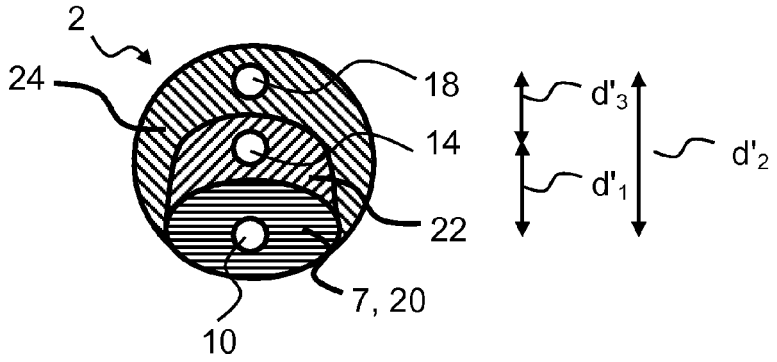
FIG. 3 is an end view of an earmold seen from the tip end

FIG. 3 shows an exemplary end view of an earmold, e.g. g the earmold 2. The first microphone opening 10, the receiver opening 14, and the vent opening 18 are arranged in first surface 20, second surface 22, and third surface 24, respectively, of the earmold shell 4. The first position is closest to the tip end compared with the second position and/or the third position. In the earmold 2, the first surface 20 corresponds to the tip surface 7. As can be seen from FIG. 3, the openings 10, 14, and 18 are not coinciding in a transverse plane perpendicular to the axis X i.e. the transverse distances between the openings 10, 14, and 18 are non-zero.

Returning to FIG. 1, the earmold 2 comprises a second microphone 32 connected to the processing unit 30 via third conductor 31 for receiving an external input signal from the second microphone 32 to be compensated according to a hearing loss of the user wearing the earmold by the processing unit 30. The second microphone 32 and the processing unit 30 are accommodated within the earmold shell 4. In one or more alternative earmolds, the second microphone 32 and/or the processing unit 30 may be positioned external to the earmold shell 4.

Figure 6:
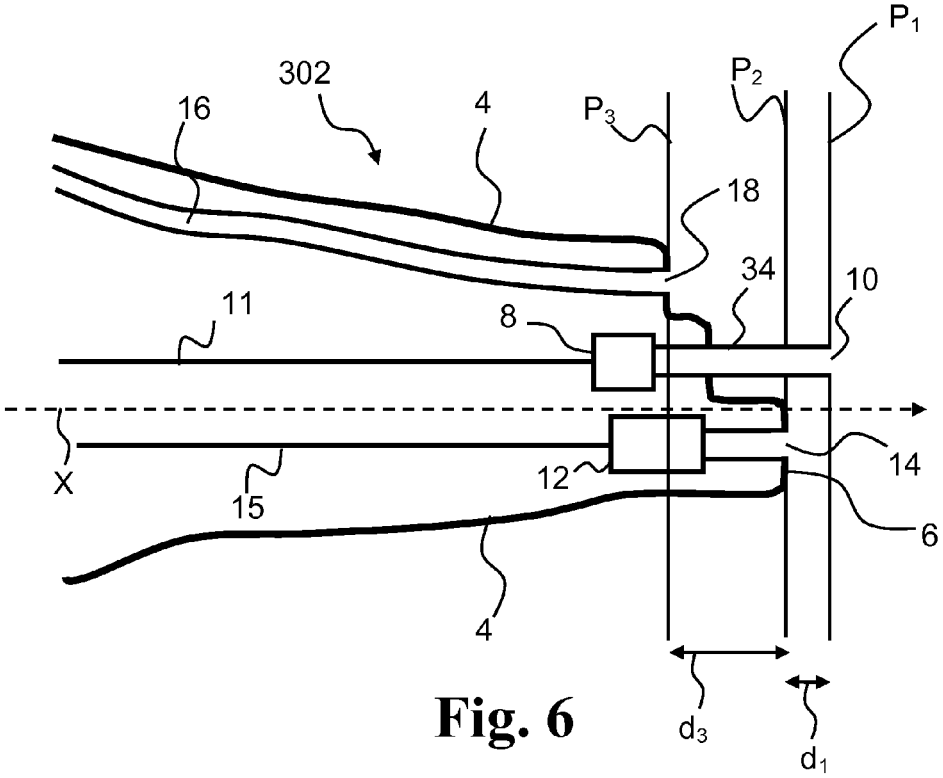
FIG. 6 schematically illustrates an exemplary earmold.
Figure 8:
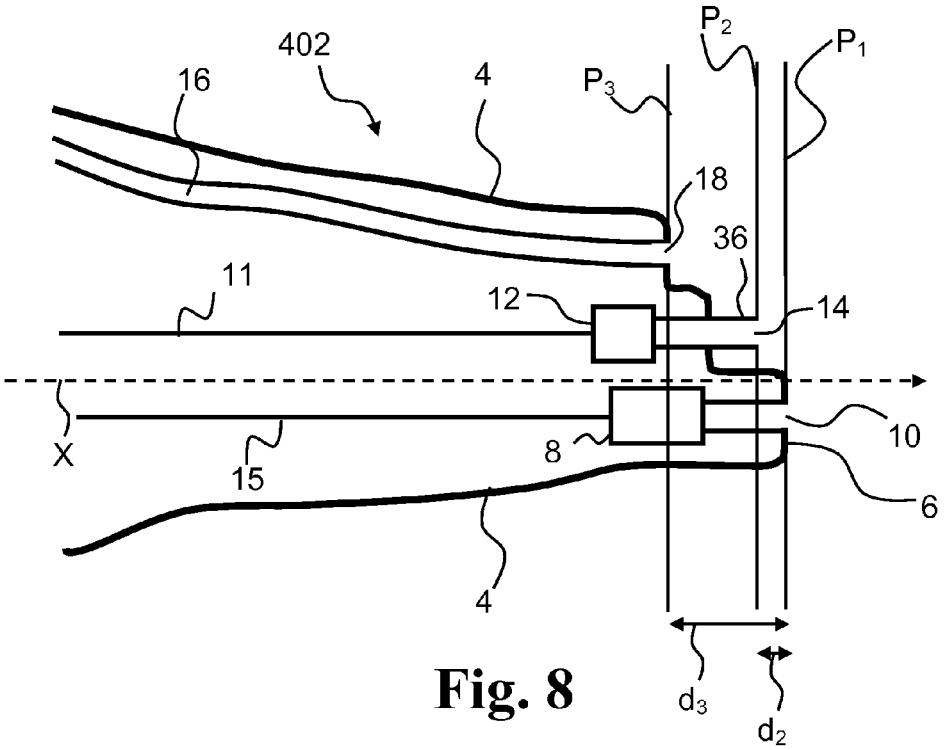
FIG. 8 schematically illustrates an exemplary earmold.

The earmold 2 may comprise a microphone tube extending from the earmold shell with the first microphone opening formed at a distal end of the microphone tube as shown in FIG. 6. The earmold 2 may comprise a receiver tube extending from the earmold shell with the receiver opening formed at a distal end of the receiver tube as shown in FIG. 8.

Figure 2:
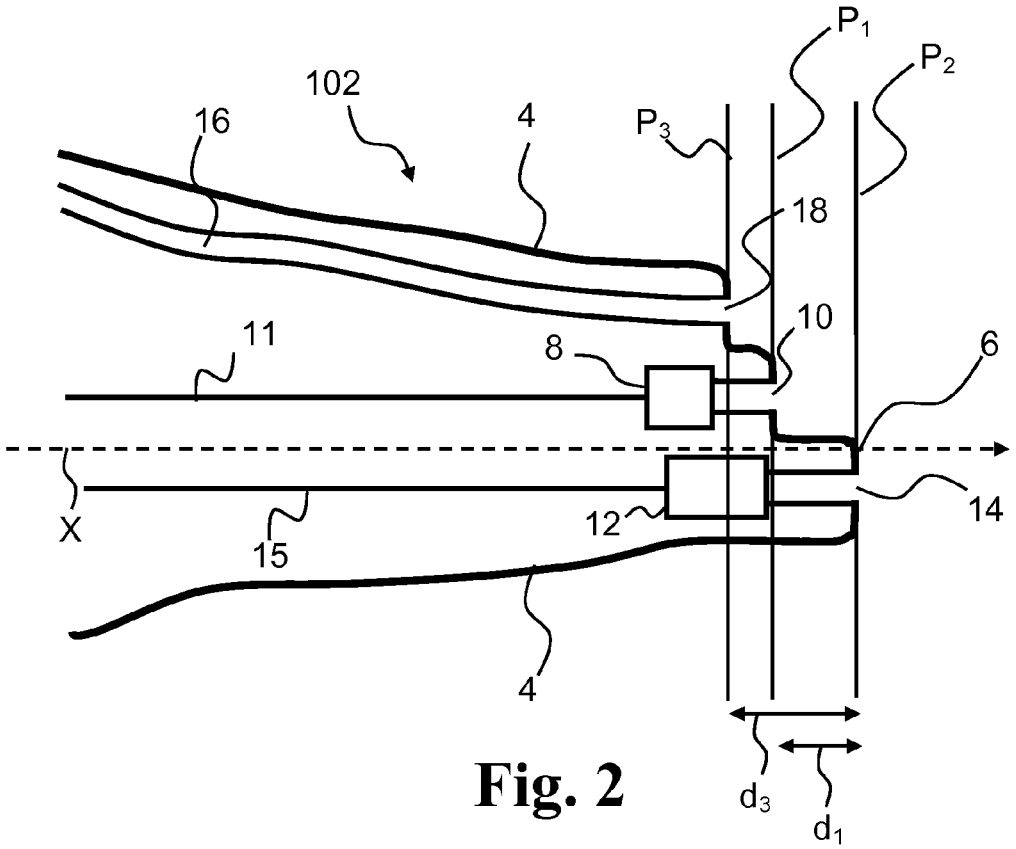
FIG. 2 schematically illustrates an exemplary earmold.

FIG. 2 illustrates an exemplary earmold 102 similar to the earmold 2. In the earmold 102, the receiver opening 14 is arranged closer to the tip end ($d_2=0$) than the first microphone opening ($d_1=2$ mm). The conductors 11, 15 are connected to a processing unit (not shown) for performing occlusion cancellation in the output signal to the receiver 12 based on the input signal from the first microphone 8.

FIG. 3 is an end view of an exemplary earmold, such as earmold 2. The first microphone opening 10 is arranged in the first surface 20 of the earmold shell 4 being the tip surface 7. The receiver opening 14 is arranged in the second surface 22 of the earmold shell 4 and the vent opening 18 is arranged in the third surface 24 of the earmold shell 4. The transverse distance between the first microphone opening 10 and the receiver opening 14 is 2 mm. The transverse distance between the first microphone opening 10 and the vent opening 18 is 4 mm. The transverse distance between the receiver opening 14 and the vent opening 18 is 2 mm.

Figure 4:
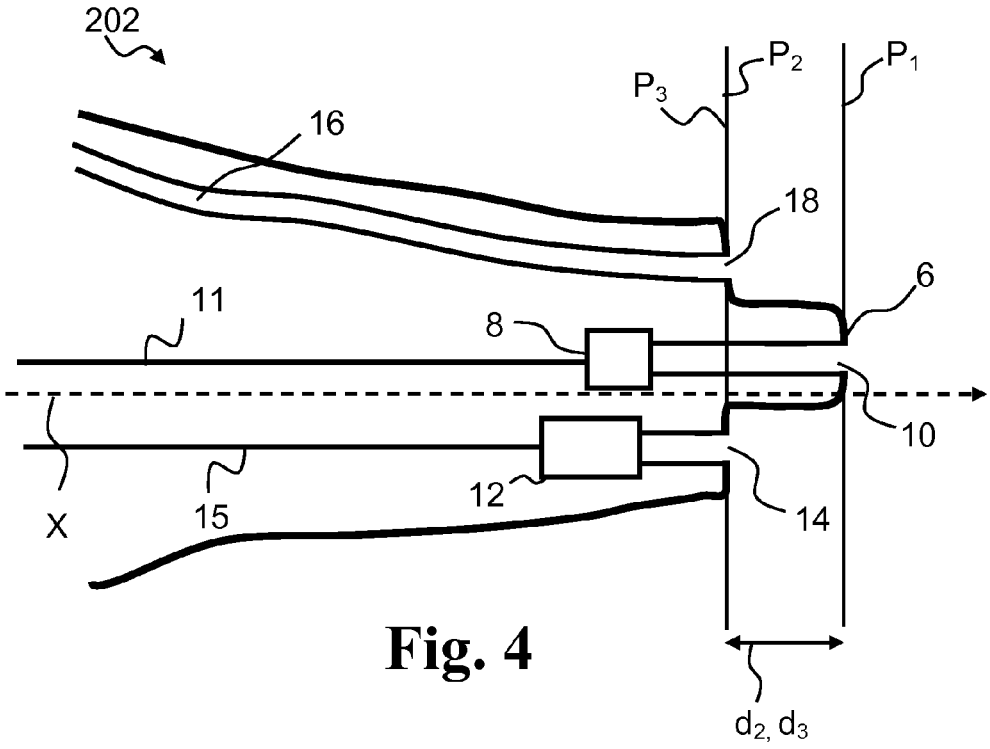
FIG. 4 schematically illustrates an exemplary earmold.
Figure 5:
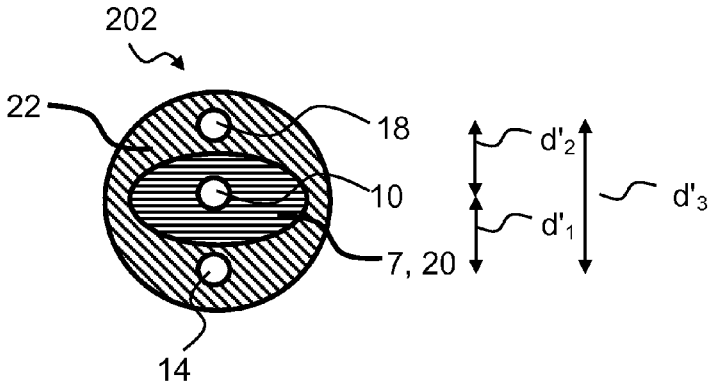
FIG. 5 is an end view of an earmold seen from the tip end.

FIGS. 4 and 5 illustrate an exemplary earmold 202. The receiver opening 14 and the vent opening 18 are arranged at the same distance from the tip end 6 along the axis X. The transverse distance between the first microphone opening 10 and the receiver opening 14 is 2 mm. The transverse distance between the first microphone opening 10 and the vent opening 18 is 2 mm. The transverse distance between the receiver opening 14 and the vent opening 18 is 4 mm. The openings 10, 14, and 18 are not coinciding in a transverse plane perpendicular to the axis X i.e. the transverse distances between the openings 10, 14, and 18 are non-zero.

FIG. 6 illustrates an exemplary earmold 302. The earmold 302 comprises a microphone tube 34 extending from the earmold shell 4 with the first microphone opening 10 formed at a distal end of the microphone tube 34. The first microphone opening 10 can be positioned close to the tympanic membrane.

Figure 7:
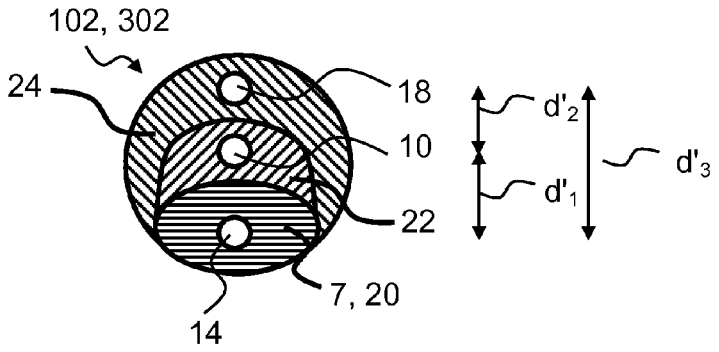
FIG. 7 is an end view of an earmold seen from the tip end.

FIG. 7 is an end view of an exemplary earmold, such as earmolds 102 or 302. The first microphone opening 10 is arranged in the second surface 22 (earmold 102) or in the microphone tube (earmold 302). The receiver opening 14 is arranged in the first surface 20 of the earmold shell 4 being the tip surface 7. The vent opening 18 is arranged in the third surface 24 of the earmold shell 4. The first transverse distance $d'_1$ between the first microphone opening 10 and the receiver opening 14 is 2 mm. The second transverse distance $d'_2$ between the first microphone opening 10 and the vent opening 18 is 2 mm. The third transverse distance $d'_3$ between the receiver opening 14 and the vent opening 18 is 4 mm.

FIG. 8 illustrates an exemplary earmold 402. The earmold 402 comprises a receiver tube 36 extending from the second surface 22 of the earmold shell 4 with the receiver opening 14 formed at a distal end of the receiver tube 36. In the earmold, the first microphone opening 10 may be arranged in a microphone tube extending from the tip surface 7.

Figure 9:
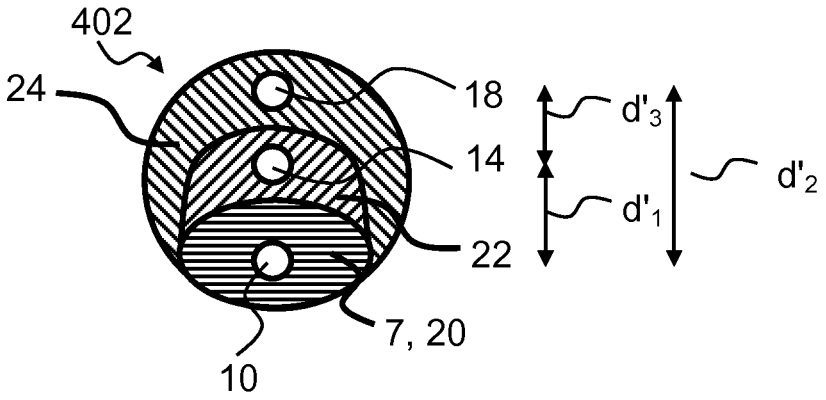
FIG. 9 is an end view of an earmold seen from the tip end.

FIG. 9 is an exemplary end view of earmold 402. The first microphone opening 10 is arranged in the first surface 20 of the earmold shell 4 being the tip surface 7. The receiver opening 14 is arranged in the receiver tube extending from the second surface 22 of the earmold shell 4, and the vent opening 18 is arranged in the third surface 24 of the earmold shell 4. The transverse distance between the first microphone opening 10 and the receiver opening 14 is 2 mm. The transverse distance between the first microphone opening 10 and the vent opening 18 is 4 mm. The transverse distance between the receiver opening 14 and the vent opening 18 is 2 mm.

Characteristics of exemplary earmolds A-E are set out in the table below, where $d_1$ is the first distance, $d_2$ is the second distance, $d_3$ is the third distance, $d'_1$ is the transverse distance between the first microphone opening and the receiver opening, $d'_2$ is the transverse distance between the first microphone opening and the vent opening, and $d'_3$ is the transverse distance between the receiver opening and the vent opening.

| | A | B | C | D | E |
|---|---|---|---|---|---|
| $d_1$ | 0-1 mm | 0-1 mm | 0-1 mm | 1-3 mm | 0-1 mm |
| $d_2$ | 1-3 mm | 1-3 mm | $>d_1$ | $<d_1$ | $>d_1 + 2$ mm |
| $d_3$ | 2-5 mm | $d_2$ | $>d_2$ | $>d_1$ | $d_2$ |
| $d'_1$ | 1-3 mm | 2 mm | >1 mm | >1 mm | >2 mm |
| $d'_2$ | 1-5 mm | 2 mm | >1 mm | >1 mm | >2 mm |
| $d'_3$ | 1-3 mm | 2 mm | >1 mm | >1 mm | >2 mm |

Although particular exemplary earmolds have been shown and described, it will be understood that it is not intended to limit the claimed inventions to the exemplary earmolds, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

LIST OF REFERENCES

2, 102, 202, 302, 402 earmold
4 earmold shell
6 tip end
7 tip surface
8 first microphone
10 first microphone opening
11 first conductor
12 receiver
14 receiver opening
15 second conductor
16 vent channel
18 vent opening
20 first surface
22 second surface
24 third surface
30 processing unit
31 third conductor
32 second microphone
33 second microphone opening
34 microphone tube
36 receiver tube
$P_1$ microphone plane
$P_2$ receiver plane
$P_3$ vent plane
$d_1$ first distance
$d_2$ second distance
$d_3$ third distance
$d'_1$ first transverse distance
$d'_2$ second transverse distance
$d'_3$ third transverse distance
X axis

The invention claimed is:

1. An earmold for an ear canal of a user, the earmold having an earmold shell, the earmold shell having a tip end, the tip end configured for facing a tympanic membrane of the user when the earmold is worn by the user, the earmold comprising:

a first microphone connected to a first microphone opening for receiving sound in the ear canal, the first microphone opening defining an opening plane and having an axis perpendicular to the opening plane; and a receiver opening for providing sound in the ear canal;

wherein the first microphone opening is on an exterior surface of the earmold or outside the exterior surface of the earmold;

wherein the receiver opening is on the exterior surface of the earmold or outside the exterior surface of the earmold;

wherein the first microphone opening and the receiver opening are at different respective longitudinal positions with respect to the axis, and wherein the axis is offset from the receiver opening.

2. The earmold according to claim 1, wherein the first microphone opening and the receiver opening are offset from each other in a direction that is perpendicular to the longitudinal axis.

3. The earmold according to claim 1, wherein a difference between the respective longitudinal positions of the first microphone opening and the receiver opening is at least 1 mm.

4. The earmold according to claim 3, wherein a difference between the respective longitudinal positions of the first microphone opening and the receiver opening is anywhere from 1.5 mm to 5 mm.

5. The earmold according to claim 1, further comprising a vent channel with a vent opening for venting the ear canal.

6. The earmold according to claim 5, wherein a difference between the longitudinal position of the first microphone opening and a longitudinal position of the vent opening is at least 1 mm.

7. The earmold according to claim 6, wherein a difference between the longitudinal position of the first microphone opening and the longitudinal position of the vent opening is anywhere from 1.5 mm to 5 mm.

8. The earmold according to claim 5, wherein the longitudinal position of the receiver opening is different from a longitudinal position of the vent opening.

9. The earmold according to claim 1, wherein the first microphone opening is less than 1 mm from the tip end of the earmold shell.

10. The earmold according to claim 1, wherein the first microphone opening and/or the receiver opening are arranged in the earmold shell.

11. The earmold according to claim 1, further comprising a microphone tube extending from the earmold shell, wherein the first microphone opening is at a distal end of the microphone tube.

12. The earmold according to claim 1, further comprising a receiver tube extending from the earmold shell, wherein the receiver opening is at a distal end of the receiver tube.

13. The earmold according to claim 1, further comprising a receiver connected to the receiver opening.

14. A hearing device comprising the earmold according to claim 1, the hearing device comprising a processing unit connected to a receiver and a microphone, wherein the processing unit comprises an occlusion cancelling unit configured to provide an output signal to the receiver based on an input signal from the microphone.

15. The earmold according to claim 1, wherein the longitudinal axis corresponds with a lengthwise direction of the ear canal.

16. The earmold of claim 1, wherein the first microphone opening and the receiver opening are positioned relative to each other such that the tympanic membrane is closer to the first microphone opening than the receiver opening when the earmold is worn by the user.

17. An earmold for an ear canal of a user, the earmold having an earmold shell, the earmold shell having a tip end, the tip end configured for facing a tympanic membrane of the user when the earmold is worn by the user, the earmold comprising:

a microphone opening of a microphone channel configured for coupling with a microphone; and a receiver opening configured for providing sound in the ear canal, the receiver opening associated with a receiver channel;

wherein the microphone opening is on an exterior surface of the earmold or outside the exterior surface of the earmold wherein the receiver opening is on the exterior surface of the earmold or outside the exterior surface of the earmold;

wherein the microphone opening and the receiver opening are at different respective longitudinal positions with respect to a longitudinal axis of the microphone channel; and wherein a difference between the respective longitudinal positions of the microphone opening and the receiver opening is at least 1 mm.

18. The earmold of claim 17, wherein the microphone opening and the receiver opening are positioned relative to each other such that the tympanic membrane is closer to the microphone opening than the receiver opening when the earmold is worn by the user.

19. The earmold of claim 17, wherein the microphone channel and the receiver channel are offset relative to each other in a direction that is perpendicular to the longitudinal axis of the microphone channel.

20. An earmold for an ear canal of a user, the earmold having an earmold shell, the earmold shell having a tip end, the tip end configured for facing a tympanic membrane of the user when the earmold is worn by the user, the earmold comprising:

a microphone opening of a microphone channel configured for coupling with a microphone;

a receiver opening for providing sound in the ear canal, the receiver opening associated with a receiver channel; and a vent opening for venting the ear canal;

wherein the microphone opening is on an exterior surface of the earmold or outside the exterior surface of the earmold wherein the receiver opening is on the exterior surface of the earmold or outside the exterior surface of the earmold; and wherein the microphone opening and the receiver opening are at different respective longitudinal positions with respect to a longitudinal axis of the microphone channel.

21. The earmold of claim 20, wherein the longitudinal position of the receiver opening is different from a longitudinal position of the vent opening.

22. The earmold of claim 20, wherein the microphone opening and the receiver opening are positioned relative to each other such that the tympanic membrane is closer to the microphone opening than the receiver opening when the earmold is worn by the user.

23. The earmold of claim 20, wherein the microphone channel and the receiver channel are offset relative to each other in a direction that is perpendicular to the longitudinal axis of the microphone channel.

24. An earmold for an ear canal of a user, the earmold having an earmold shell, the earmold shell having a tip end, the tip end configured for facing a tympanic membrane of the user when the earmold is worn by the user, the earmold comprising:

a microphone connected to a microphone opening for receiving sound in the ear canal, the microphone opening associated with a microphone channel; and a receiver opening for providing sound in the ear canal;

wherein the microphone opening is on an exterior surface of the earmold or outside the exterior surface of the earmold;

wherein the receiver opening is on the exterior surface of the earmold or outside the exterior surface of the earmold;

wherein the microphone opening and the receiver opening are at different respective longitudinal positions with respect to a longitudinal axis of the microphone channel.

25. The earmold of claim 24, wherein the microphone channel and the receiver channel are offset relative to each other in a direction that is perpendicular to the longitudinal axis.

* * * * *